US008112933B1

(12) United States Patent
Swan

(10) Patent No.: US 8,112,933 B1
(45) Date of Patent: Feb. 14, 2012

(54) MOUNTING ASSEMBLY WITH ADJUSTABLE SPRING TENSION AND PIVOTING LOCK LEVER

(76) Inventor: Richard E. Swan, E. Bridgewater, MA (US)

( * ) Notice: Subject to any disclaimer, the term of this patent is extended or adjusted under 35 U.S.C. 154(b) by 0 days.

(21) Appl. No.: 13/008,063

(22) Filed: Jan. 18, 2011

Related U.S. Application Data

(63) Continuation-in-part of application No. 12/271,309, filed on Nov. 14, 2008, now Pat. No. 7,905,045, which is a continuation-in-part of application No. 11/933,506, filed on Nov. 1, 2007, now Pat. No. 7,757,423.

(60) Provisional application No. 61/295,824, filed on Jan. 18, 2010, provisional application No. 60/864,022, filed on Nov. 2, 2006.

(51) Int. Cl.
*F41G 1/38* (2006.01)

(52) U.S. Cl. ..... 42/127; 42/124; 42/125; 403/374.5

(58) Field of Classification Search ..... 42/72, 90, 42/124, 125, 126, 127, 128; 403/373, 374.1, 403/374.2, 374.5, 381; 248/229.1, 229.12, 248/229.13, 229.14, 229.2, 229.21, 229.23, 248/229.24, 226.11, 228.2, 228.3, 28.4, 228.5
See application file for complete search history.

(56) References Cited

U.S. PATENT DOCUMENTS 1,158,260 A * 10/1915 Moerbe ..... 411/207
1,225,785 A * 5/1917 Dervoz ..... 411/208
1,428,655 A 9/1922 Noske
2,161,051 A 6/1939 Humeston
3,877,166 A 4/1975 Ward
4,845,871 A 7/1989 Swan
4,860,480 A 8/1989 Ruger
4,905,396 A 3/1990 Bechtel
5,155,915 A 10/1992 Repa
5,276,988 A 1/1994 Swan
5,606,818 A 3/1997 Hardee
5,669,173 A 9/1997 Rodney, Jr.
5,680,725 A 10/1997 Bell
5,847,535 A * 12/1998 Nordquist et al. ..... 318/700
5,937,559 A * 8/1999 Jennen ..... 42/94
6,295,754 B1 10/2001 Otterman et al.
6,442,883 B1 9/2002 Waterman et al.
(Continued)

OTHER PUBLICATIONS

TM 9-4931-710-14&P, Technical Manual, Operator, Organizational, Direct Support and General Support Maintenance Manual, Headquarters, Department of the Army, Aug. 1986.

*Primary Examiner* — Gabriel Klein
(74) *Attorney, Agent, or Firm* — Barlow, Josephs & Holmes, Ltd.

(57) ABSTRACT

An improved mounting assembly is provided that is configured to be releasably attached to a standard dovetail rail profile, wherein the initial clamping tension of a clamping assembly is adjustable. The mounting assembly includes a main body having a lower portion that is configured to engage a standard dovetail and an upper portion accessory receiving formation. The lower portion of the mounting assembly has a first engagement member extending downwardly along one side thereof for engaging one side of the dovetail rail and a clamping assembly to engage the opposing side of the dovetail rail. At least one spring and a retention nut are provided as part of the clamping assembly such that retention nut controls the preset spring tension thereby controlling the clamping force applied by the clamping assembly. A lock lever connected to the actuator arm selectively locks the position of the retention nut on the threaded shaft.

20 Claims, 10 Drawing Sheets

U.S. PATENT DOCUMENTS

| | | | |
|---|---|---|---|
| 6,449,893 | B2 | 9/2002 | Spinner |
| 6,490,822 | B1 | 12/2002 | Swan |
| 6,513,276 | B2 | 2/2003 | Mendoza-Orozco |
| 6,598,333 | B1 | 7/2003 | Randazzo et al. |
| 6,922,934 | B1 | 8/2005 | Huan |
| 6,931,778 | B1 | 8/2005 | Nelson et al. |
| 7,272,904 | B2 | 9/2007 | Larue |
| 2002/0170224 | A1* | 11/2002 | Lawless ..... 42/71.02 |
| 2004/0148842 | A1 | 8/2004 | Aalto et al. |
| 2006/0123686 | A1 | 6/2006 | Larue |
| 2006/0207156 | A1 | 9/2006 | Larue |
| 2008/0155876 | A1 | 7/2008 | Matthews et al. |
| 2008/0168696 | A1 | 7/2008 | Orne et al. |
| 2008/0178511 | A1 | 7/2008 | Storch et al. |

* cited by examiner

MOUNTING ASSEMBLY WITH ADJUSTABLE SPRING TENSION AND PIVOTING LOCK LEVER

CROSS-REFERENCE TO RELATED APPLICATIONS

This application claims priority to earlier filed U.S. Provisional Application Ser. No. 61/295,824, filed Jan. 18, 2010, and is a continuation-in-part of U.S. Ser. No. 12/271,309, filed on Nov. 14, 2008, now U.S. Pat. No. 7,905,045, which is a continuation-in-part of U.S. patent application Ser. No. 11/933,506, filed Nov. 1, 2007, now U.S. Pat. No. 7,757,423, which is related to and claims priority from earlier filed U.S. Provisional Patent Application No. 60/864,022, filed Nov. 2, 2006. The entire contents of all earlier filed applications are incorporated herein by reference.

BACKGROUND OF THE INVENTION

1. Field of the Invention

The present invention relates generally to modular integrated accessory mounting assemblies for combat weapons. More specifically, the present invention relates to an accessory mounting assembly, which includes a clamping assembly that provides adjustable spring tension to control the clamping force exerted against the firearm interface rail.

2. Background of the Related Art

As the field of combat and commercial weaponry expands, numerous add-on enhancements have become available for attachment to standard firearms, thereby significantly upgrading the capability of the firearm. Of particular interest in the area of combat weapons is the well-known M16/M4 weapon system (M16 and M4 are trademarks of Colt Defense, Inc.). The M16 has been in service for a number of years and will continue to be a popular rifle both in U.S. and foreign militaries for the foreseeable future. Generally, the M16/M4 weapon 2, as depicted in FIG. 1, includes a lower receiver 4, upper receiver 6, butt stock 8, and barrel 10.

The newer models of the M16/M4 weapons further include a mil-std 1913 dovetail rail 12 extending along the top of the upper receiver. This integrated receiver rail 12 provides a convenient mounting point for many types of enhancement devices such as scopes and other sighting devices.

In addition, many supplemental rail systems for M16/M4 weapons have also been created. As shown in FIG. 2, these supplemental rail interface systems for weapons 2 generally include an upper hand guard 14, a means 16 for securing the upper hand guard 14 to the weapon 2, a lower firearm accessory 18 (in most cases this is a lower hand guard), various optional rail segments, and in many cases, a sling swivel 20 for attaching a shoulder sling to carry the weapon 2. The upper hand guard 14 is generally semi-cylindrical in shape and has a forward end and a rearward end and a mil-std 1913 dovetail rail 22 extending longitudinally between the forward end and the rearward end.

The increasing development and refinement of laser sights, infrared lighting, visible lighting, night vision, and specialized scopes and magnifiers, and other accessories continues to drive the need for versatile and reliable integration systems that can support this important equipment and yet stand the test of rugged military use and abuse.

An existing attachment device is disclosed in U.S. Pat. No. 5,276,988, issued on Jan. 11, 1994 to the present applicant, the contents of the '988 patent being incorporated herein by reference. Generally, the prior art attachment assemblies include a main body 24 having a lower portion that is configured to engage the dovetail rail 22 found on most modern combat weapons 2 and an upper portion 26 that can take on a variety of configurations depending on the accessory that is to be mounted thereon. The lower portion of the attachment assembly has a first engagement member 28 extending downwardly along one side thereof for engaging one side of the dovetail rail 22. Further, a boss formation 30 is provided adjacent the side of the main body 24 to receive a clamping assembly 32 that is particularly suited to be releasably engaged with a second side of the dovetail rail such that the clamping assembly 32 cooperates with the first engagement member to retain the attachment assembly in its installed position on the dovetail rail 22. The clamping assembly 32 generally includes a foot portion 32A with a cam surface 32B to engage the angulated surface of the dovetail rail 12, a post extending upwardly through the boss formation 30 and a head portion 32C secured to the top end of the post and having actuator arm 32D to facilitate rotation of the foot portion 32A. The clamping assembly 32 further includes spring washers, which are captured between the bottom surface of the head portion 32C and the boss 30 (or a bushing within the boss) to provide a self-adjusting amount of spring tension as the clamping assembly 32 is rotated into engagement with the dovetail rail 22. These springs generally allow a limited, self-adjusted amount of biased vertical movement of the foot portion 32A relative to the boss 30 and the dovetail rail 22. Because the head portion 32C of the clamping assembly 32 is secured in a fixed position on the top end of the post, the spring are compressed by a fixed amount and therefore the force exerted by the foot portion 32A on the dovetail rail 22 was generally variable, but variable only within a certain range as determined by the initial spring tension. This small range of self-adjustment is critical in being able to accommodate the small dimensional variations in the dovetail rails 22 of various equipment manufacturers.

Further, when such devices are employed with sighting accessories it is critical that the alignment of the device be repeatable and reliable after several removal and reinstallation cycles. If the camming force is too loose, the sight cannot be reinstalled with a high degree of accuracy. Similarly, if the camming force is too great, rotation of the foot portion 32A can damage the dovetail rail 22 creating a sloppy fit over time.

Finally, despite the benefits of a fixed, self-adjusting range of spring tension provided by the prior art device, in certain environments, there is still a perceived need to adjust the range of the spring tension, for example if dovetail rails have excessive wear there may be a need to slightly increase the initial spring tension. However, there is also a desire to prevent the user of the weapon 2 from being able to adjust the tension without some type of restriction. Tighter is not better in these circumstances and over tightening can lead to damage to the rail 22 of the weapon 2. Accordingly, while a need for adjustment may be accommodated, it should be provided in a manner that accommodates all of the environmental variables while still allowing the accessory mount to be ruggedly attached to the rail 22. There is thus a struggle between the benefits of a fixed mounting so as to provide a fixed, self-adjusting range of spring tension, and the perceived need to be able to adjust the range of the spring tension.

Accordingly, there is a perceived need for a mounting assembly that allows for the releasable mounting of various accessories onto the standard dovetail rail 22 found on modern combat weapons 2 and that can be reliably mounted onto a dovetail rail 22 while including an actuator that includes the ability to adjust the spring tension that is exerted by the clamping foot.

SUMMARY OF THE INVENTION

In this regard, the present invention provides for an improved mounting assembly that is configured to be releasably attached to a standard dovetail rail profile wherein the clamping tension of the clamping assembly is adjustable.

The mounting assembly of the present invention generally includes a main body having a lower portion that is configured to engage the dovetail rail found on most modern combat weapons and an upper portion that can take a variety of configurations depending on the accessory that is to be mounted thereon. A boss formation including an opening extends outwardly to the side of the main body. A bushing including a central opening is mounted within the opening of the boss formation. The lower portion of the main body has a first engagement member extending downwardly along one side thereof for engaging one side of the dovetail rail.

The clamping assembly comprises a foot portion positioned adjacent the bottom surface of the boss formation and an actuator arm extending from the foot portion. The foot portion includes a cam surface similar to the prior art foot portion. A shaft extends upwardly from the top surface of the foot portion through the opening in the bushing. At least one spring is received around the shaft adjacent the upper surface of the bushing, and a retention nut is threaded onto the upper end of the shaft such that the spring is captured between the bottom surface of the retention nut and the upper surface of the bushing. The spring is compressed as the retention nut is tightened thereby providing for adjustment of the spring tension of the clamping assembly.

The retention nut includes a plurality of indexing slots around the peripheral edge thereof as well as a plurality of corresponding indexing marks on the upper surface of the retention nut for reference by the operator.

To insure that the retention nut remains in the position set by the user, actuator arm includes a spring-biased indexing and lock lever that engages the indexing slots on the outer surface of the retention nut.

The indexing and lock lever is pivotally mounted on the actuator arm adjacent to the retention nut. The index and lock lever is configured and arranged with a blade end that engages in the indexing slots in the retention nut and an actuator end that is moved by the user to move the blade end into and out of engagement with the retention nut.

The lock lever is pivotally mounted about a horizontal pin extending through the actuator arm so that downward movement of the actuator end of the lever causes upward movement of the blade end. The lock lever is normally biased by a spring to a down or engaged position with the retention nut. The spring is captured in the actuator arm between a recess on the actuator arm and a bottom surface of the actuator end of the lever.

Pivoting movement of the lock lever may be reversed to the lower side of the actuator arm with the pivot pin in the same location so that a forward movement of the actuator end would cause a corresponding upward movement of the blade end. The actuator pin remains in the same location, and the lever extends through the actuator arm to the lower side thereof.

Accordingly, it is an object of the present invention to provide an improved mounting assembly that allows for the releasable mounting of various accessories onto the standard dovetail rail found on modern combat weapons. Further, it is an object of the present invention to provide a mounting assembly that can be reliably mounted onto a dovetail rail while including an actuator that includes the ability to adjust the spring tension that is exerted by the clamping foot. It is still a further object of the present invention to provide a mounting assembly having an adjustable actuator that further includes a retention nut that allow a user to predictably and reliably control the spring tension and clamping force of the mounting assembly.

These, together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DESCRIPTION OF THE PREFERRED EMBODIMENT

Figure 1:
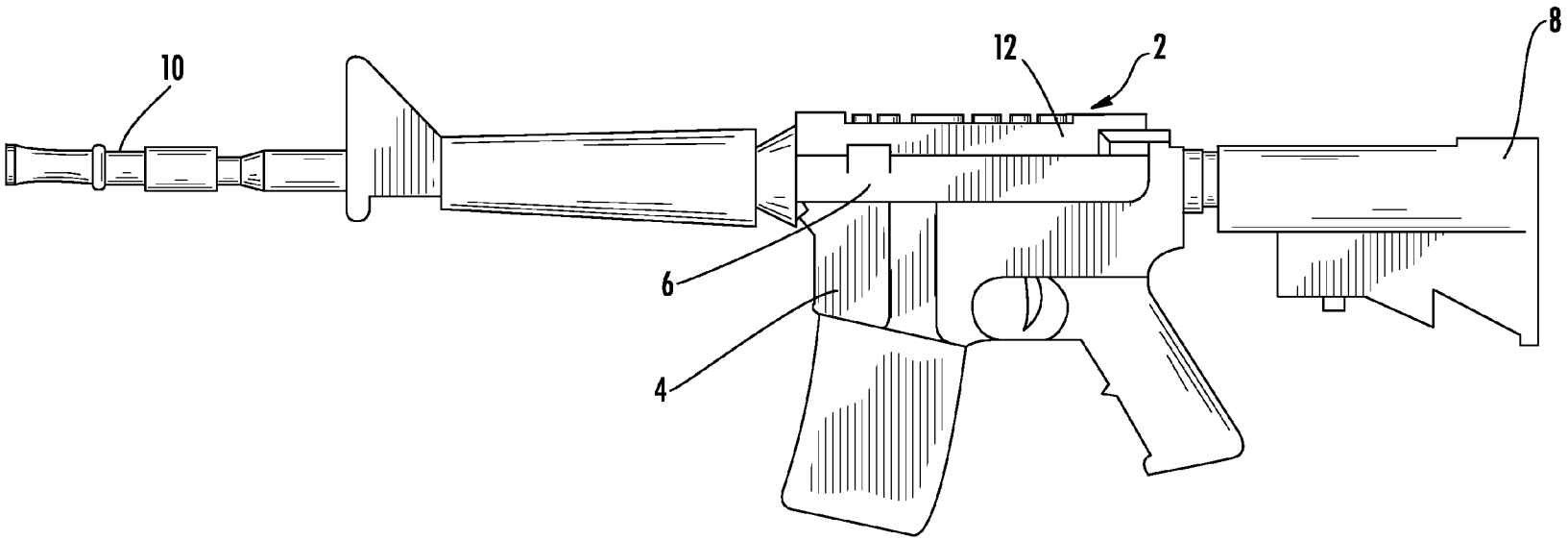
FIG. 1 (PRIOR ART)
FIG. 1 is a side view of a prior art combat firearm.
Figure 2:
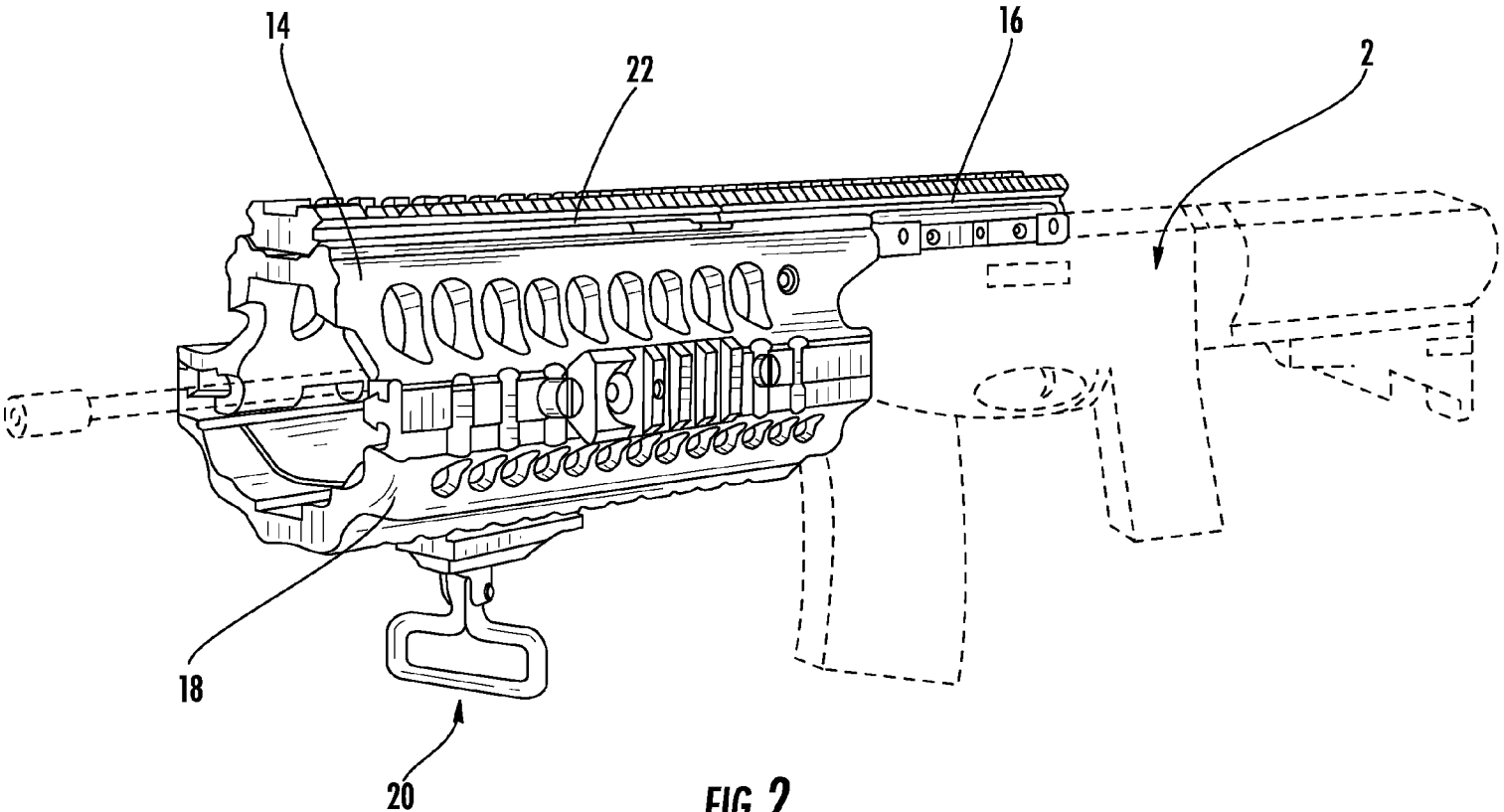
FIG. 2 (PRIOR ART)
FIG. 2 is a perspective view of a prior art rail interface system.

Now referring to the drawings, the mounting assembly is shown and generally illustrated at 40 in FIGS. 4-10. The mounting assembly 40 is configured to be releasably attached to a standard dovetail rail profile 12 as is depicted in FIG. 1, and includes a means for adjustment to control the clamping force exerted by the mounting assembly 40 against the dovetail rail 12, as will be discussed in more detail below. The mounting assembly 40 of the present invention is particularly suited for use in connection with any firearm 2 that utilizes a standard dovetail rail 12 or the dovetail rail 22 of a supplemental rail system as depicted in FIG. 2. The mounting assembly 40 is also suitable for use with any weapon system or device that utilizes a dovetail rail as a platform for attachment.

Figure 4:
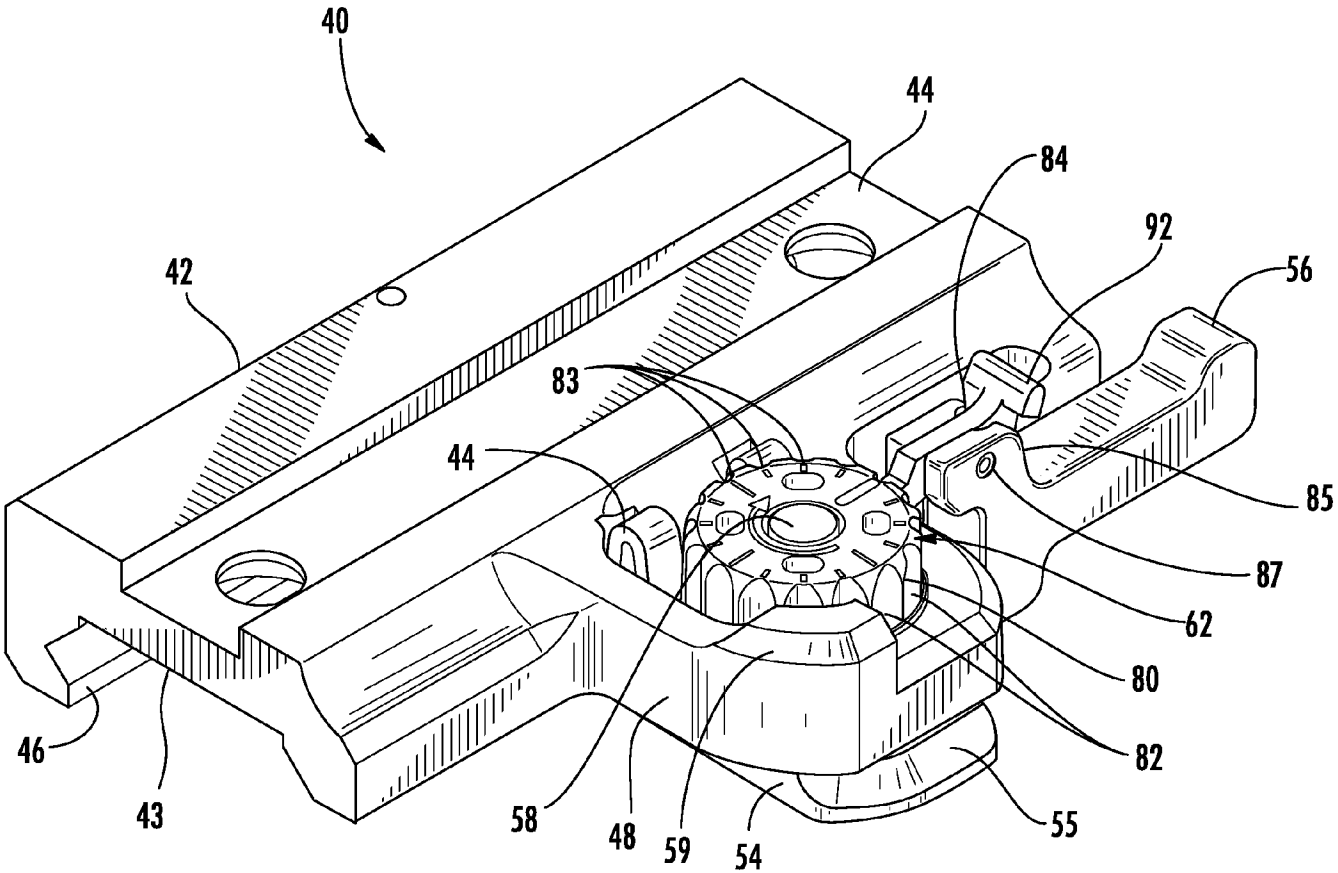
FIG. 4 is a perspective view of the mounting assembly of the present invention.
Figure 5:
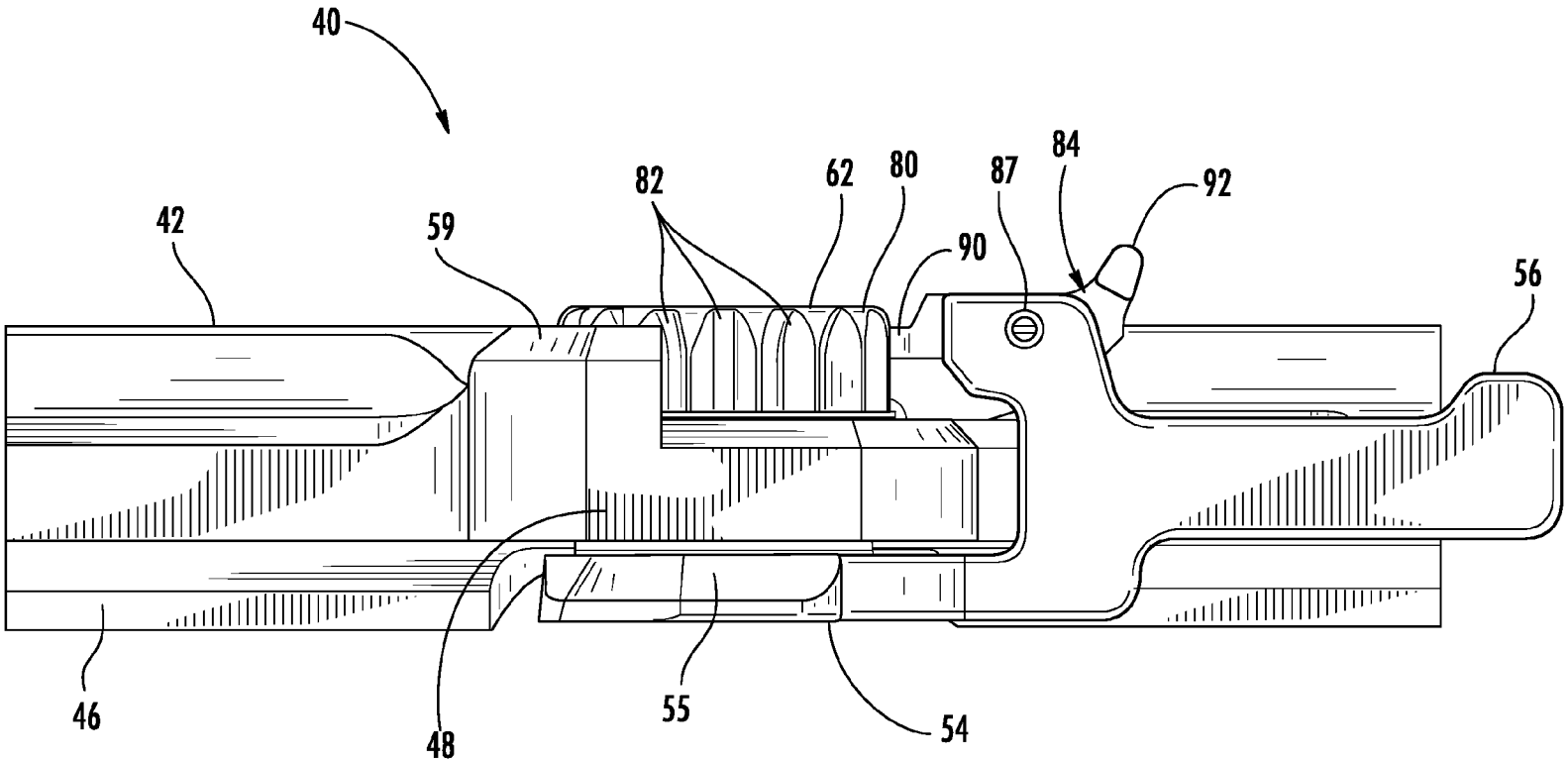
FIG. 5 is a right side view of the mounting assembly of the present invention.
Figure 6:
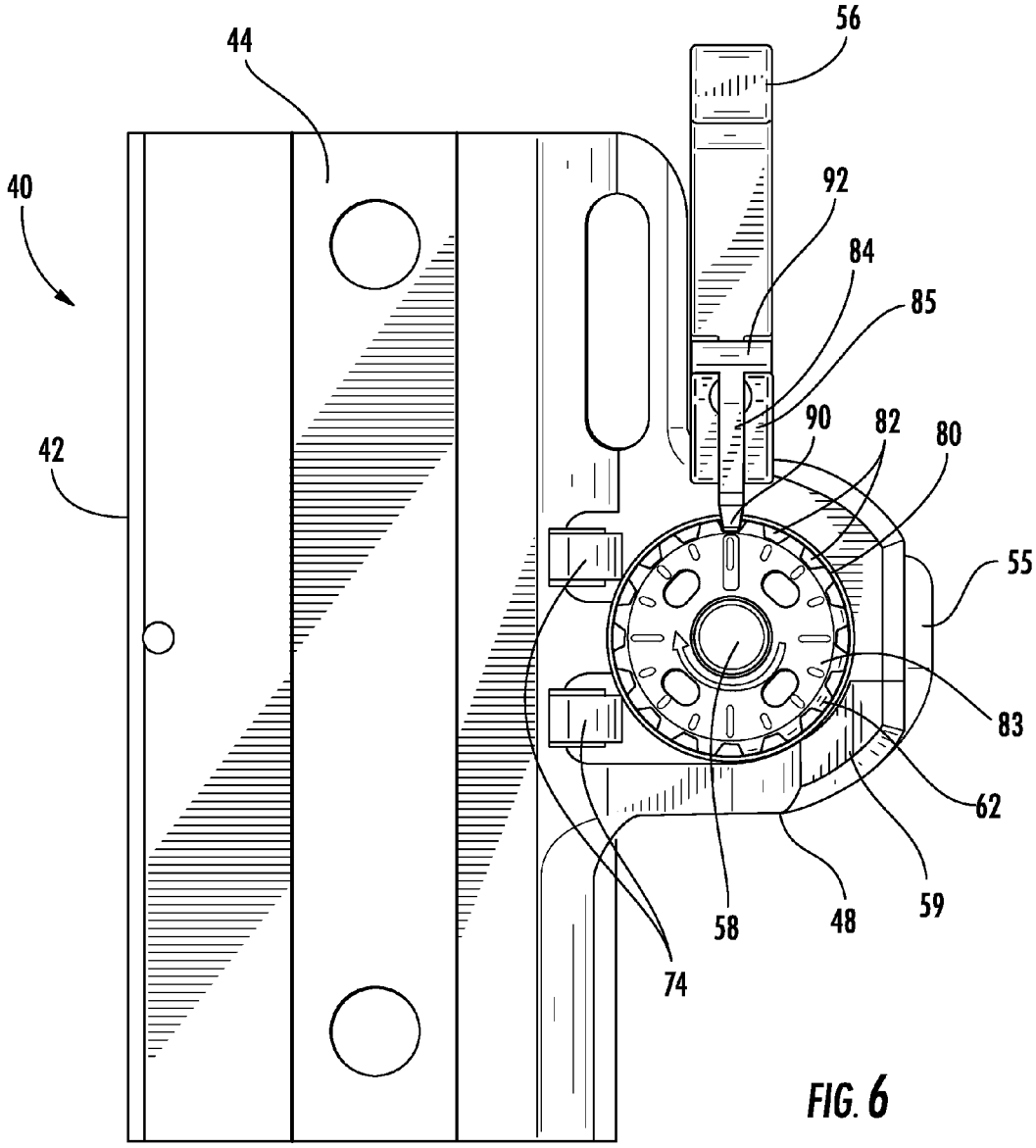
FIG. 6 is a top view of the mounting assembly of the present invention.
Figure 7:
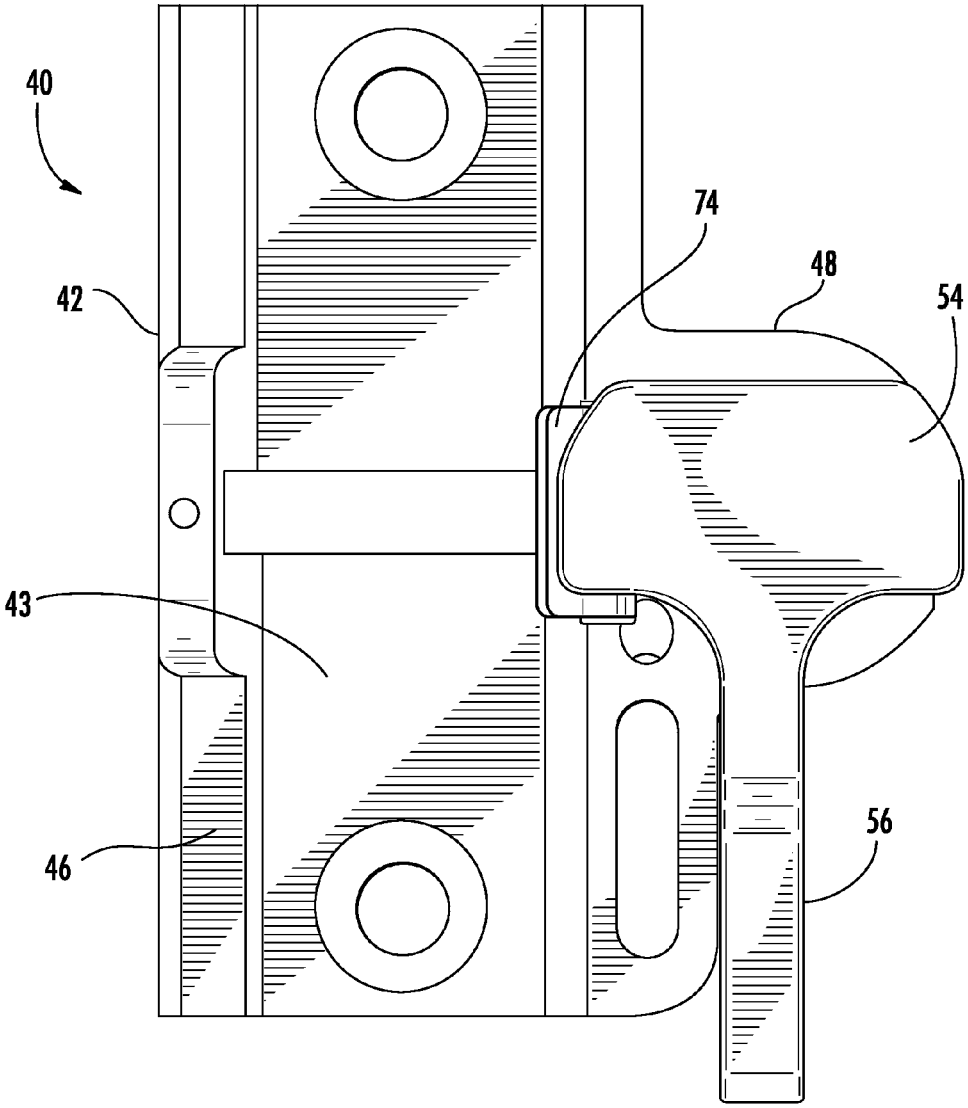
FIG. 7 is a bottom view of the mounting assembly of the present invention.
Figure 8:
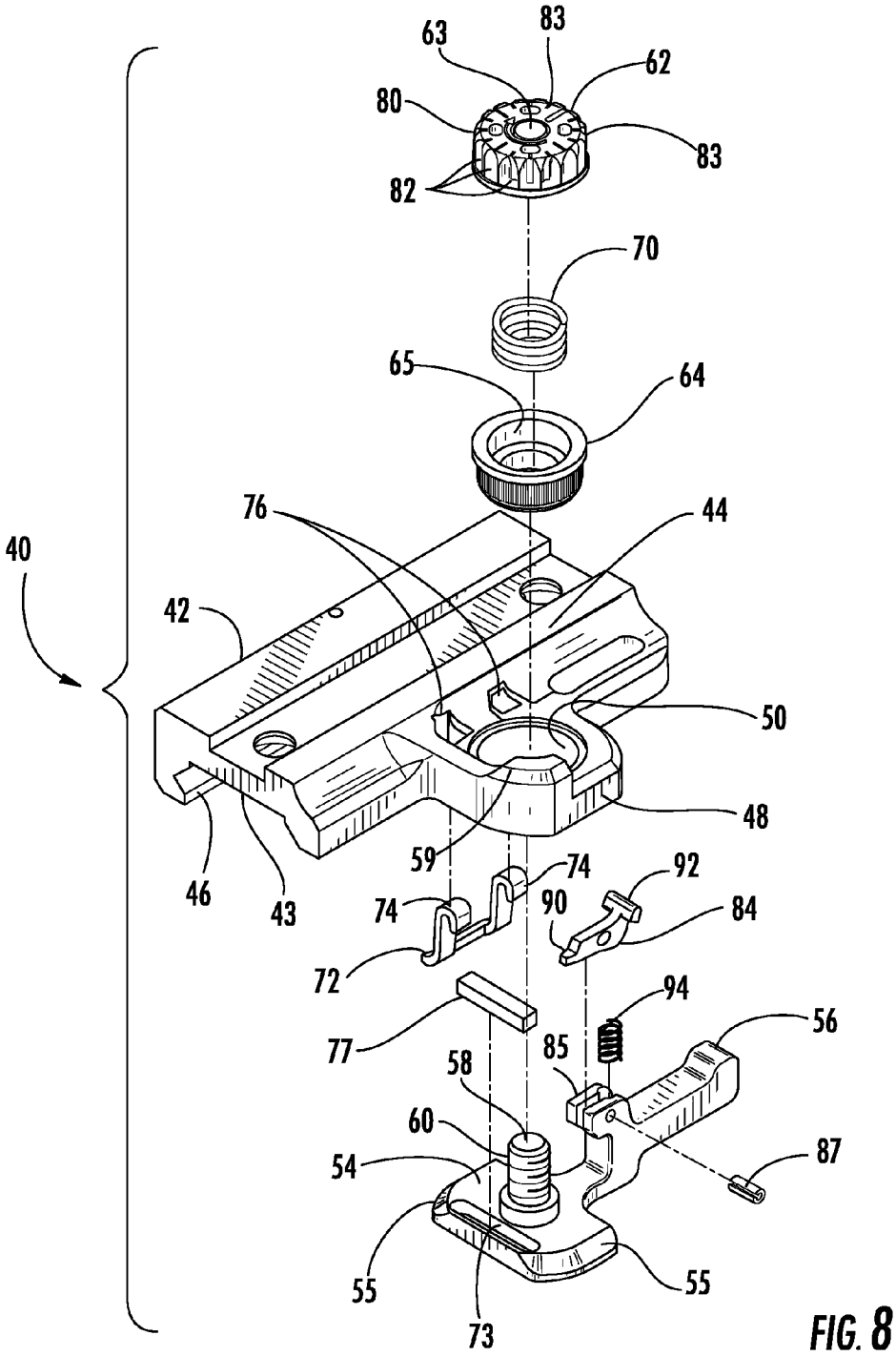
FIG. 8 is an exploded perspective view of the mounting assembly of the present invention.
Figure 9:
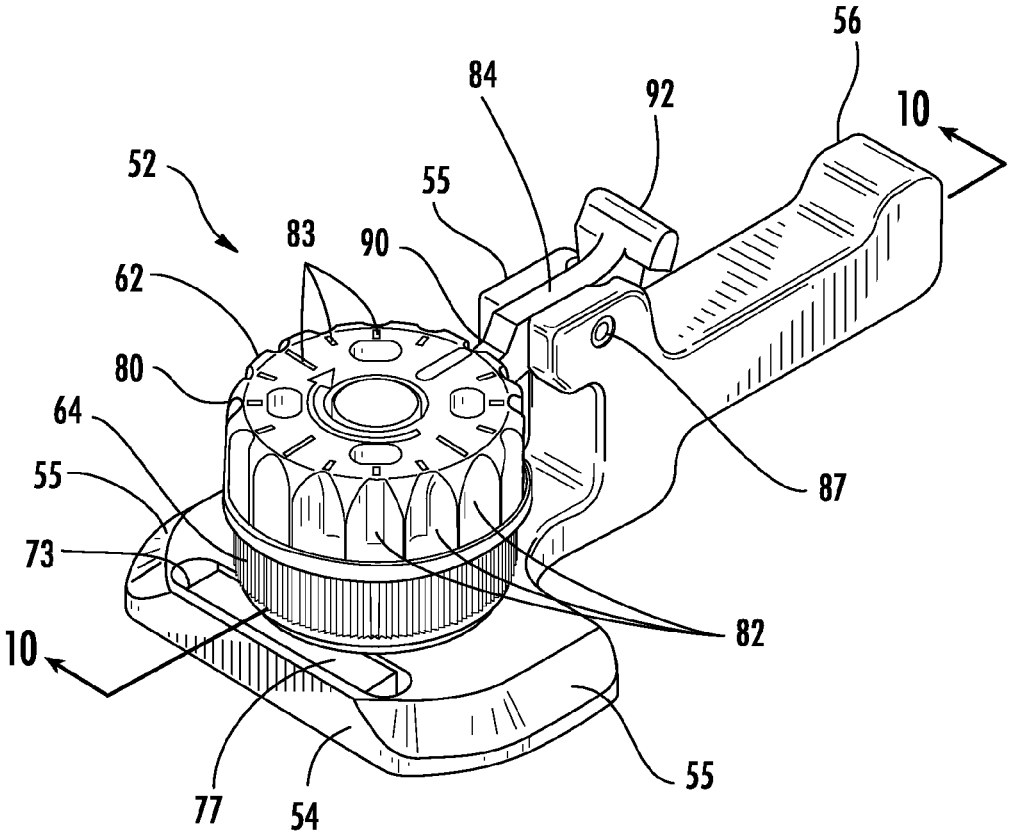
FIG. 9 is a partial view of the foot assembly of the mounting assembly of the present invention.
Figure 10:
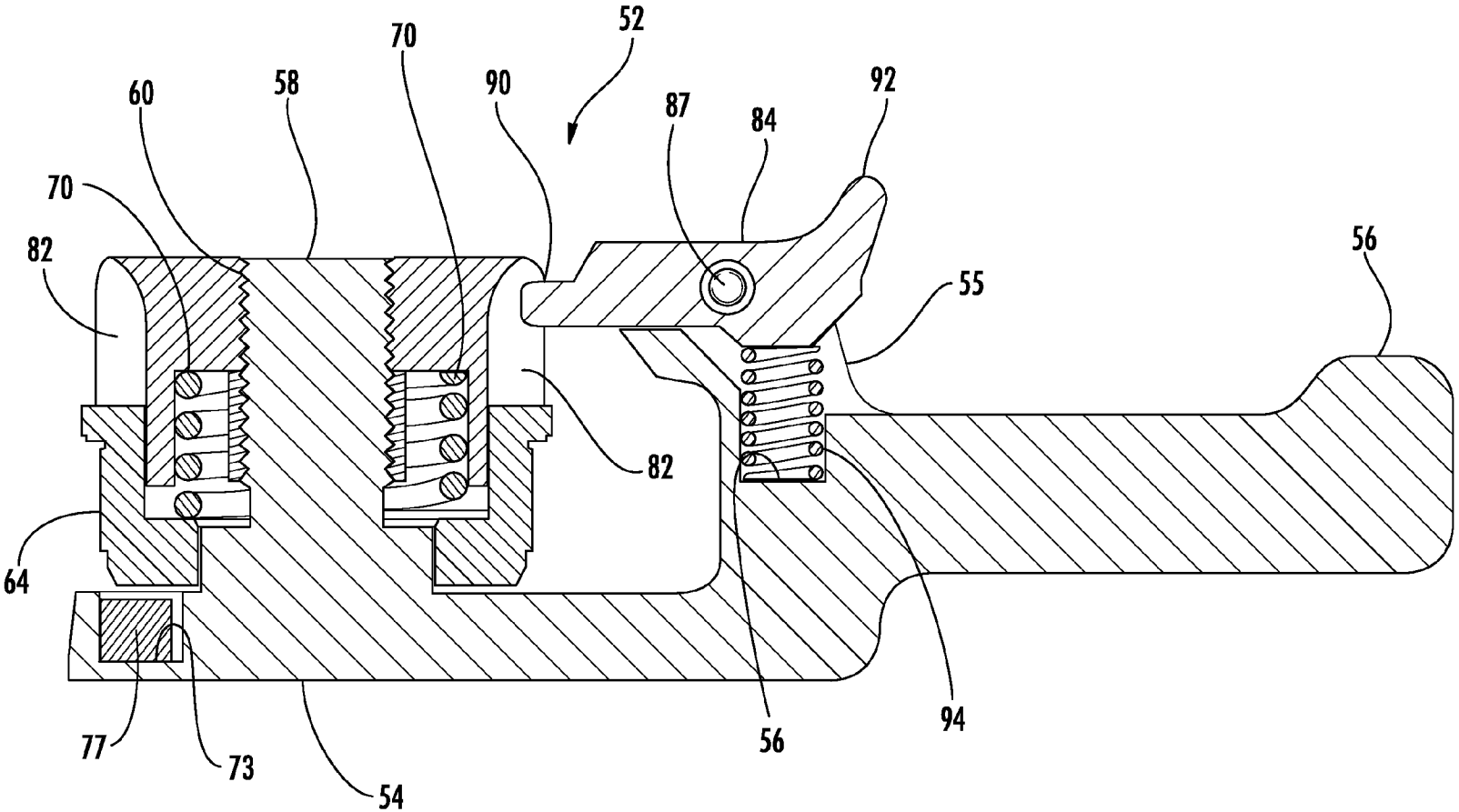
FIG. 10 is a cross-section view through line 10-10 of FIG. 9.

Turning now to FIG. 4, as can be seen, the mounting assembly 40 includes a main body 42 that is configured in substantially the same manner as a traditional prior art device and further includes a lower portion 43 that is configured to engage the dovetail rail 12 found on most modern combat weapons 2 and an upper portion 44 that can take on a variety of configurations depending on the accessory that is to be mounted thereon. As can best be seen in FIG. 6, the lower portion 43 of the main body 42 has a first engagement member 46 extending downwardly along one side thereof for engaging one side of the dovetail rail 12. Opposite the first engagement member 46, a boss formation 48 is provided adjacent the side of the main body 42 wherein the boss formation 48 includes a large central opening 50 therein to receive a clamping assembly generally indicated at 52. An annular bushing 64 with a smaller central opening 65 is installed into the large central opening 50.

Figure 3A:
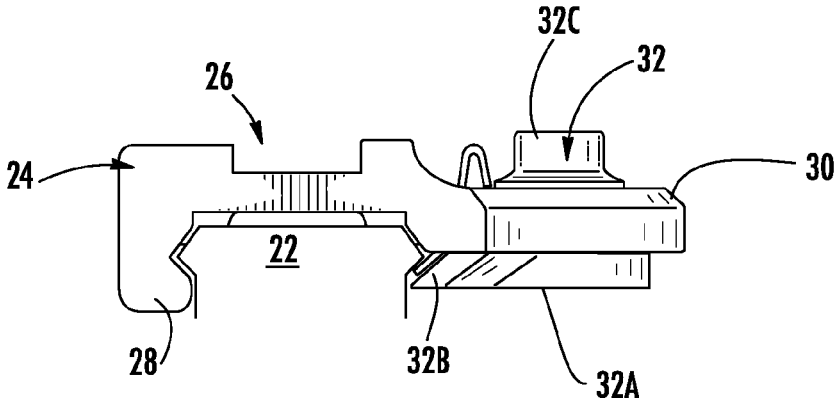
FIG. 3A (PRIOR ART)
FIG. 3A is an end view of a prior art mounting assembly in the engaged position.
Figure 3B:
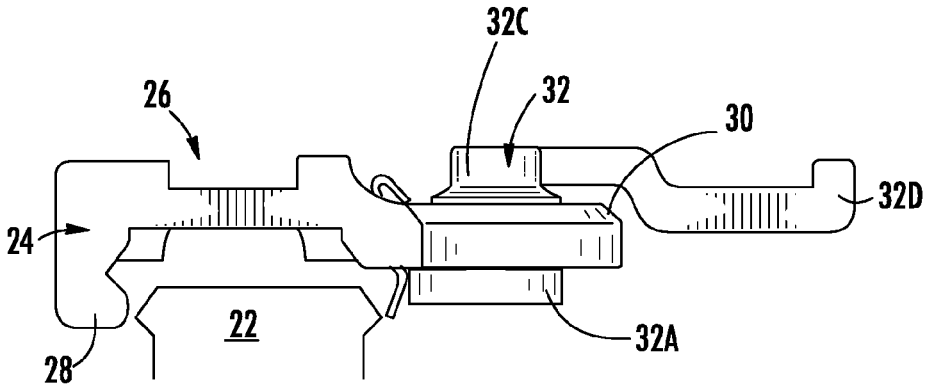
FIG. 3B (PRIOR ART)
FIG. 3B is an end view of a prior art mounting assembly in the disengaged position.

Turning back now to FIG. 4, in the scope of the present invention, the clamping assembly 52 replaces the clamping assembly of the prior art as is depicted in FIGS. 3A and 3B. In the present invention, the clamping assembly 52 is configured to releasably engage a dovetail rail interface 12 with a self-adjusting clamping force that has an adjustable range of spring tension. The clamping assembly 52 and the first engagement member 46 cooperate to hold the main body 42 on the dovetail rail 12.

The clamping assembly 52 is received into and supported by the boss formation 48 that extends outwardly from the side of the body 42 of the mounting assembly 40. The clamping assembly 52 generally includes a foot portion 54 that is positioned adjacent the bottom surface of the boss 48 formation. The foot portion 54 includes an angulated cam surface 55 that extends around the side surface of the foot portion 54 as in the prior art devices. However, in contrast to the prior art as described, the actuator arm 56 extends outwardly directly from the foot portion 54 below the boss formation 48 rather then being attached to the foot above the boss formation. The foot portion 54 may be configured as a dual-sided foot so that only one foot and arm need be provided for either left or right hand mounting assemblies. The actuator arm 56 extends outwardly directly from the foot portion 54 below the boss formation 48 and allows the user to rotate the foot portion 54 between engaged and disengaged positions. A shoulder 59 extending from said boss 48 formation may be provided to prevent said actuator arm 56 from being rotated passed said disengaged position. A shaft 58 is affixed to and extends upwardly from the foot portion 54 through the bushing 64 and terminates in a threaded end 60.

At least one spring 70 in the form of a coil spring or spring washer is received around the shaft 58 and is seated on the bottom wall of the bushing 64.

A retention nut 62 having a threaded bore 63 is threadedly received on the threaded terminal end 60 of the shaft 58 such the spring 70 is captured between the bottom surface of the retention nut 62 and the upper surface of the bottom wall of the bushing 64. The spring 70 is compressed as the retention nut 62 is tightened thereby providing for adjustment of the initial spring tension of the clamping assembly 52.

There is also shown a steel buffer pad 72 having a flat horizontal base portion with an arm 74 at each end of the base extending upwardly at an oblique angle of 135 degrees. The free end of each arm 74 is curved approximately 150 degrees. Two side-by-side openings 76, corresponding in separation to the separation between buffer pad arms 74, are formed in the main body 42. The arms 74 of the buffer pad 72 are slid through the openings 76. In operation, the buffer element 72 sits between the angulated surface of the rail 12 and the cam surface 55 of the foot portion 54. Rotation of the actuator arm 56 causes the foot portion 54 to press the buffer element 72 into the side of the firearm rail 12. The buffer element 72 prevents the foot portion 54 from directly touching and thereby marring the outer surface of the firearm rail 12. Rotation of the actuator arm 56 and the consequent movement of the foot portion 54 against the buffer element 72 overcomes the resistance of the spring washers 70 and moves the buffer element 72 against the engagement surface of the rail interface 12. The foot portion 54 may further include a recess 73 thereon to hold a magnet 77. In the disengaged position, the magnet 77 will pull the buffer pad 72 towards the foot portion 74 and away from the first engagement member 46 thereby allowing the mounting assembly 40 to be easily removed or place on the rail without the buffer pad 72 swinging in the way.

To insure that the retention nut 62 remains in a position as set by the user, the clamping assembly 52 further comprises a locking means for positively locking the position of the retention nut 62 on the threaded shaft 58. The locking means preferably comprises at least one locking formation (indexing slot) 82 on the outer edge surface 80 of the retention nut 62 and a pivoting lock lever 84. The indexing slots 82 extend all the way around the outer surface 80 of the retention nut 62 to provide a wide range of adjustment. Indexing marks 83 may also be provided on the top surface of the retention nut 62 to allow a user to determine the amount of spring tension being applied. The lock lever 84 is received within a cradle 85 formed in the handle portion of the actuator arm 56 and is held in place by a roll pin 87. The lock lever 84 includes a blade end 90 that engages in the indexing slots 82 in the retention nut 62 and an actuator end 92 that is pressed by the user to move the blade end 90 into and out of engagement with the indexing slots 82 on the retention nut 62.

The lock lever 84 is pivotally mounted about a roll pin 87 extending through the cradle 85 of the actuator arm 56 so that downward movement of the actuator end 92 of the lock lever 84 causes upward movement of the blade end 90. The lock lever 84 is normally biased by a spring 94 to a down or engaged position with the indexing slots 82 on the retention nut 62. The biasing spring 94 is captured in the actuator arm between a recess 96 on the actuator arm 56 and a bottom surface of the actuator end 92 of the lock lever 84.

Because the spring 70 is trapped between the retention nut 62 and the bushing 64, tightening of the retention nut 62 causes compression of the spring 70, shortens the range of the vertical travel of the foot portion 54 relative to the bottom surface of the boss 48 and increases the spring clamping force. Accordingly, when the actuator arm 56 rotates the foot portion 54 into engagement with the rail 12, additional spring pressure is exerted on dovetail rail 12. Similarly, as the retention nut 62 is loosened, the compression of the spring 70 is reduced, the range of vertical travel of the foot portion 54 is increased, and the clamping force is reduced. In order to tighten or loosen the retention nut 62, the actuator end of the lock lever 84 is pressed down relative to the actuator 56 until the blade end of the locking pin 84 is clear of the indexing slots 82 in the retention nut 62 thereby allowing rotation of the retention nut 62 relative to the clamping assembly 52. After the retention nut 62 is adjusted and the desired spring tension is set, the actuator end of the lock lever 84 is released and the blade end is allowed to engage with the indexing slots 82 on the retention nut 62 preventing rotation of the retention nut relative to the clamping assembly 52.

It can further be appreciated that the actuator end 92 of the lock lever 84 may include texturing or knurling thereon to facilitate pressing of the lock lever 84 by hand.

Accordingly, it can be seen that the present invention provides a unique and novel modular accessory mount that fills a critical need for soldiers in the field by ensuring positive and reliable operation. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A mounting assembly for attaching an accessory to a dovetail rail interface on a firearm, said mounting assembly comprising:

a body having a lower portion and an upper portion, said lower portion configured to engage a first side of said dovetail rail, said upper portion configured to receive and retain said accessory;

a boss formation extending outwardly from a side of said body and including an opening therein;

a clamping assembly configured to releasably engage a second side of said dovetail rail, including, a foot portion positioned adjacent a bottom surface of said boss formation, said foot portion including a cam surface;

an actuator arm extending outwardly from said foot portion;

a shaft affixed to said foot portion and extending upwardly through said opening in said boss formation, a terminal end of said shaft being threaded;

a spring received around said shaft adjacent the top surface of said boss formation;

a retention nut threadedly received on said terminal end of said shaft such that said spring is captured between a bottom surface of said retention nut and a top surface of said boss formation, the retention nut having a plurality of indexing slots on an outer circumference thereof; and a lock lever pivotably connected directly to said actuator arm, said lock lever configured and arranged to engage the indexing slots on the retention nut to allow a user to lock the position of said retention nut on said threaded shaft, wherein movement of said clamping assembly to releasably engage said dovetail rail causes said foot portion to clamp against said second side of said dovetail rail.

2. The mounting assembly of claim 1, wherein said lock lever includes a blade end for engaging said retention nut and a pressable actuator end, wherein said blade end of said lock lever engages said retention nut and prevents accidental rotation of said retention nut relative to said shaft when said actuator end is released and said lock lever disengages said blade end from said retention nut when said actuator end is pressed.

3. The mounting assembly of claim 1, further comprising a second spring biasing said lock lever into engagement with said retention nut.

4. The mounting assembly of claim 1, wherein said clamping assembly further comprises a bushing received within said opening in said boss formation, said bushing including an opening, said shaft of said clamping assembly extending through said opening in said bushing, said spring being captured between the bottom surface of said retention nut and a top surface of said bushing.

5. The mounting assembly of claim 1, wherein said spring is a coil spring.

6. The mounting assembly of claim 1, further comprising a buffer pad pivotally attached adjacent a bottom surface of said lower portion and adjacent said clamping assembly, wherein movement of said clamping assembly to releasably engage said dovetail rail causes said foot portion to clamp said buffer pad against said second side of said dovetail rail.

7. The mounting assembly of claim 1, wherein said boss formation includes a shoulder formation configured and arranged to prevent rotation of said actuator arm beyond a disengaged position.

8. The mounting assembly of claim 1, wherein said foot portion further includes a second cam surface.

9. The mounting assembly of claim 1, wherein said foot portion further includes a recess formed adjacent to said cam surface with a magnet secured therein.

10. A mounting assembly for attaching an accessory to a dovetail rail interface on a firearm, said mounting assembly comprising:

a body having a lower portion and an upper portion, said lower portion configured to engage a first side of said dovetail rail, said upper portion configured to receive and retain said accessory;

a boss formation extending outwardly from a side of said body and including an opening therein;

a clamping assembly configured to releasably engage a second side of said dovetail rail, including, a foot portion positioned adjacent a bottom surface of said boss formation, said foot portion including a cam surface;

a shaft affixed to said foot portion and extending upwardly through said opening in said boss formation, a terminal end of said shaft being threaded;

a first spring received around said shaft adjacent the top surface of said boss formation;

an actuator arm positioned around said shaft and above said first spring, said actuator arm engaged with said shaft such that rotation of said actuator arm causes rotation of said shaft and said camming foot; and a retention nut threadedly received on said terminal end of said shaft such that said actuator arm and said spring is captured between a bottom surface of said retention nut and a top surface of said boss formation, the retention nut having a plurality of indexing slots on an outer circumference thereof;

a lock lever pivotably connected directly to said actuator arm;

a second spring biasing said lock lever into engagement with said indexing slots on said retention nut to lock the position of said retention nut on said threaded shaft; and wherein movement of said clamping assembly to releasably engage said dovetail rail causes said foot portion to clamp against said second side of said dovetail rail.

11. The mounting assembly of claim 10, wherein said lock lever includes a blade end for engaging said retention nut and a pressable actuator end, wherein said blade end of said lock lever engages said retention nut and prevents accidental rotation of said retention nut relative to said shaft when said actuator end is released and said lock lever disengages said blade end from said retention nut when said actuator end is pressed.

12. The mounting assembly of claim 10, wherein said clamping assembly further comprises a bushing received within said opening in said boss formation, said bushing including an opening, said shaft of said clamping assembly extending through said opening in said bushing, said first spring being captured between the bottom surface of said retention nut and a top surface of said bushing.

13. The mounting assembly of claim 10, wherein said first spring is a coil spring.

14. The mounting assembly of claim 10, wherein said foot portion positioned adjacent to said bottom surface of said boss formation further includes a second cam surface.

15. The mounting assembly of claim 10, wherein said foot portion further includes a recess formed adjacent to said cam surface with a magnet secured therein.

16. The mounting assembly of claim 10, wherein said boss formation includes a shoulder formation configured and arranged to prevent rotation of said actuator arm beyond a disengaged position.

17. The mounting assembly of claim 10, wherein said second spring is a coil spring.

18. The mounting assembly of claim 10, further comprising a buffer pad pivotally attached adjacent a bottom surface of said lower portion and adjacent said clamping assembly, wherein movement of said clamping assembly to releasably engage said dovetail rail causes said foot portion to clamp said buffer pad against said second side of said dovetail rail.

19. A mounting assembly for attaching an accessory to a dovetail rail interface on a firearm, said mounting assembly comprising:

a body having a lower portion and an upper portion, said lower portion configured to engage a first side of said dovetail rail, said upper portion configured to receive and retain said accessory;

a boss formation extending outwardly from a side of said body and including an opening therein;

a clamping assembly configured to releasably engage a second side of said dovetail rail, including, a foot portion positioned adjacent a bottom surface of said boss formation, said foot portion including a cam surface;

a shaft affixed to said foot portion and extending upwardly through said opening in said boss formation, a terminal end of said shaft being threaded;

a first spring received around said shaft adjacent the top surface of said boss formation;

an actuator arm positioned around said shaft and above said first spring, said actuator arm engaged with said shaft such that rotation of said actuator arm causes rotation of said shaft and said camming foot; and a retention nut threadedly received on said terminal end of said shaft such that said actuator arm and said spring is captured between a bottom surface of said retention nut and a top surface of said boss formation, the retention nut having a plurality of indexing slots on an outer circumference thereof;

a lock lever pivotally connected directly to said actuator arm;

a second spring biasing said lock lever into engagement with said indexing slots on said retention nut to lock the position of said retention nut on said threaded shaft; and a buffer pad pivotally attached adjacent a bottom surface of said lower portion and adjacent said clamping assembly; wherein movement of said clamping assembly to releasably engage said dovetail rail causes said foot portion to clamp said buffer pad against said second side of said dovetail rail.

20. The mounting assembly of claim 19, wherein said lock lever includes a blade end for engaging said retention nut and a pressable actuator end, wherein said blade end of said lock lever engages said retention nut and prevents accidental rotation of said retention nut relative to said shaft when said actuator end is released and said lock lever disengages said blade end from said retention nut when said actuator end is pressed.

* * * * *